US005971078A

United States Patent [19]

Ritorto et al.

[11] Patent Number: 5,971,078

[45] Date of Patent: Oct. 26, 1999

[54] METHOD AND APPARATUS FOR RETRIEVING DOWNHOLE TOOLS

[75] Inventors: Leonardo Ritorto; Dave L. Heinley, both of Edmonton, Canada

[73] Assignee: Canadian Downhole Drill Systems Inc., Nisku, Canada

[21] Appl. No.: 08/839,573

[22] Filed: Apr. 15, 1997

[51] Int. Cl.[6] ..... E21B 23/00

[52] U.S. Cl. ..... 166/377; 166/117.5

[58] Field of Search ..... 166/301, 311, 166/113, 240, 99, 298, 255.3, 377, 117.5

[56] References Cited

U.S. PATENT DOCUMENTS

| | | | |
|---|---|---|---|
| 1,487,061 | 3/1924 | Heflin | 166/99 |
| 2,659,441 | 11/1953 | Knapp | 166/99 |
| 4,402,551 | 9/1983 | Wood et al. | 299/5 |
| 5,318,121 | 6/1994 | Brockman et al. | 166/313 |
| 5,318,132 | 6/1994 | Odorisio | 166/382 |
| 5,335,737 | 8/1994 | Baugh | 175/61 |
| 5,341,873 | 8/1994 | Carter et al. | 166/117.5 |
| 5,361,833 | 11/1994 | Schock et al. | 166/117.6 |
| 5,398,754 | 3/1995 | Dinhoble | 166/117.6 |
| 5,409,060 | 4/1995 | Carter | 166/237 |
| 5,425,417 | 6/1995 | Carter | 166/117.6 |
| 5,425,419 | 6/1995 | Sieber | 166/206 |
| 5,427,179 | 6/1995 | Bailey et al. | 166/177.6 |
| 5,439,051 | 8/1995 | Kennedy et al. | 166/50 |
| 5,452,759 | 9/1995 | Carter et al. | 166/117.6 |
| 5,467,819 | 11/1995 | Braddick | 166/117.6 |
| 5,467,820 | 11/1995 | Seiber | 166/117.6 |
| 5,474,125 | 12/1995 | Seiber | 166/98 |
| 5,474,126 | 12/1995 | Lynde et al. | 166/117.6 |
| 5,474,131 | 12/1995 | Jordan, Jr. et al. | 166/313 |
| 5,474,133 | 12/1995 | Seiber | 166/377 |
| 5,522,461 | 6/1996 | Carter et al. | 166/298 |
| 5,533,573 | 7/1996 | Jordan, Jr. et al. | 166/313 |
| 5,551,509 | 9/1996 | Braddick | 166/55.7 |
| 5,595,247 | 1/1997 | Braddick | 166/297 |

*Primary Examiner*—Tamara L. Graysay
*Assistant Examiner*—Abdel G. Elkassed
*Attorney, Agent, or Firm*—Anthony R. Lambert

[57] ABSTRACT

A downhole retrieving tool, in which a tubular member has a tubing string connector end and a conical retrieving dish on the tubular member spaced from and opening towards the tubing string connector end. Stabilizers are spaced around the tubular member at the tubing string connector end. A retrievable whipstock comprises a concave, with a recess formed in the concave between upper and lower conical walls. The upper side wall intersects the face of the concave to form an anchor point. A method for retrieving a downhole tool, such as a whipstock, in a well, in which a retrieving tool having a retrieving dish is lowered into a well, inserted into the recess to engage an anchor point, and removed from the well. Fluid may be injected through circumferentially spaced fluid passageways communicating with the bore of the tubular member to remove unwanted material from the recess.

20 Claims, 6 Drawing Sheets

METHOD AND APPARATUS FOR RETRIEVING DOWNHOLE TOOLS

FIELD OF THE INVENTION

This invention relates to retrievable downhole tools, particularly whipstocks, and to retrieving tools, and to a method of retrieving downhole tools.

BACKGROUND OF THE INVENTION

Retrievable whipstocks are known, as shown for example in U.S. Pat. No. 5,474,133, issued Dec. 12, 1995. This patent describes a hook shaped retrieval tool which is guided along a slot cut in the face of the whipstock and engages within a retrieving slot set in the face of the whipstock. In this design, the hook must be oriented to enter the slot, as described at col. 38, lines 10–30, using orientation equipment. Use of such equipment is time consuming and adds expense to the drilling operation.

The inventors propose a tool that avoids the need for orientation of a retrieving tool when retrieving downhole tools, particularly whipstocks, from a well bore.

SUMMARY OF THE INVENTION

According to a first aspect of the invention, there is provided a downhole retrieving tool, in which a tubular member has a tubing string connector end and a retrieving dish on the tubular member spaced from and opening towards the tubing string connector end. The retrieving dish is preferably defined by inner and outer conical surfaces.

In a further aspect of the invention, plural fluid passageways in fluid communication with the bore of the tubular member extend through the retrieving dish to the perimeter of the retrieving dish at spaced circumferential positions.

The tubular member preferably has stabilizers spaced around the tubular member at the tubing string connector end.

According to a further aspect of the invention, there is provided a retrievable whipstock comprising an elongated body having a narrow end and a wide end and a slanted concave face on a first side of the elongated body, the slanted concave face extending along the elongated body between the first and second ends. A recess is formed in the elongated body between upper and lower side walls, the upper side wall being closer to the narrow end of the elongated body than the lower side wall. The upper side wall is convex and slants down towards the wide end of the elongated body to intersect the slanted concave face and form a catch point for a concave hook. Preferably, the upper side wall forms a portion of a conical surface. Also, the lower side wall is preferably concave, and, further, forms a portion of a conical surface.

According to a method according to the invention for retrieving a downhole tool in a well, wherein the downhole tool has a recess and anchor for receiving a retrieving dish, the method comprises the steps of:

- lowering into the well a retrieving tool having a retrieving dish extending circumferentially around the retrieving tool;
- inserting the retrieving dish into the recess and engaging the anchor; and
- pulling on the retrieving tool to remove the downhole tool from the well.

In the case when the retrieving dish includes circumferentially spaced fluid passageways communicating with the bore of the tubular member, the method further comprises, while inserting the retrieving dish into the recess, injecting fluid down the bore, through the fluid passageways and into the recess to remove unwanted material from the recess.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

Figure 1:
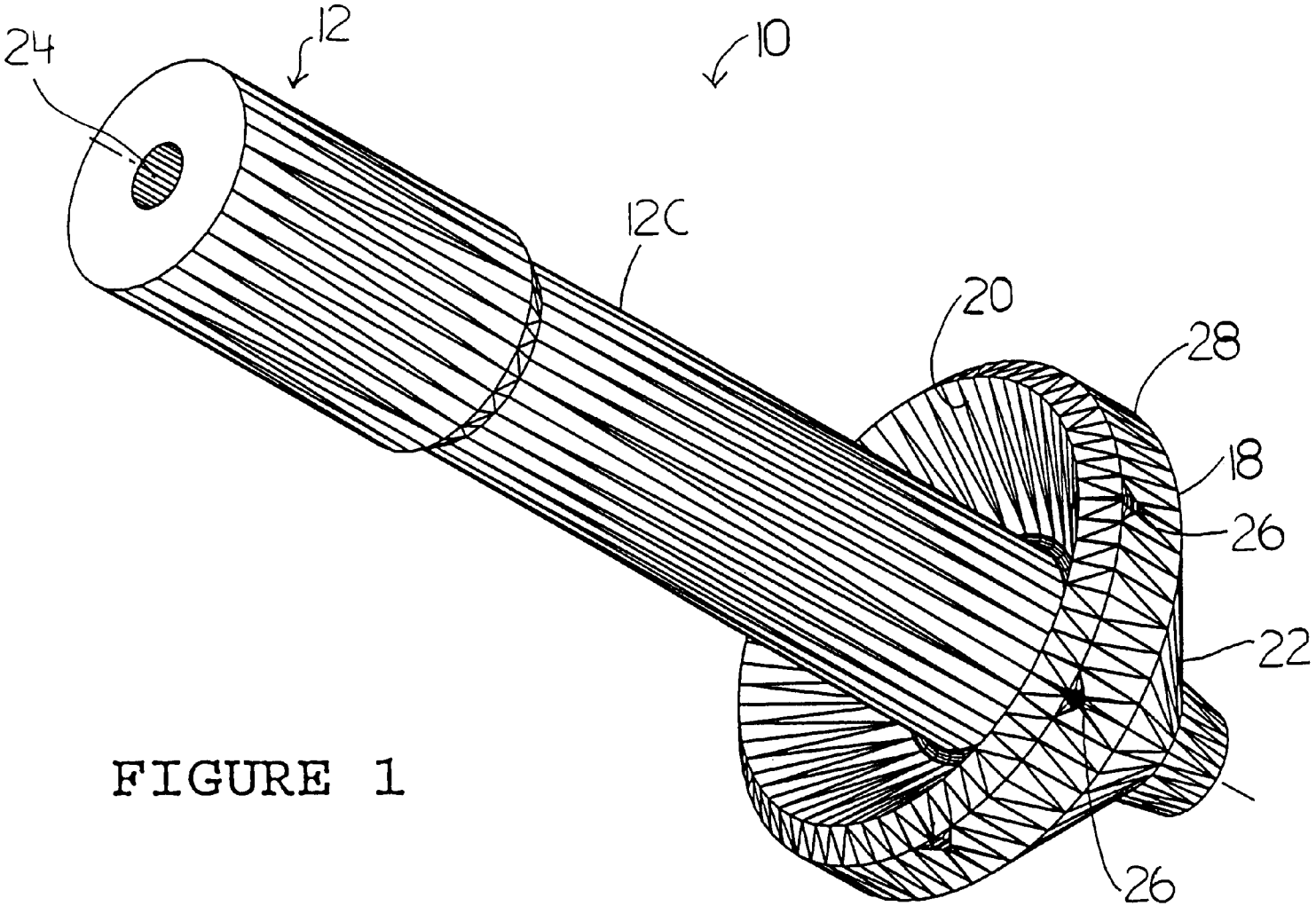
FIG. 1 is a perspective view of a retrieving tool according to the invention.
Figure 2:
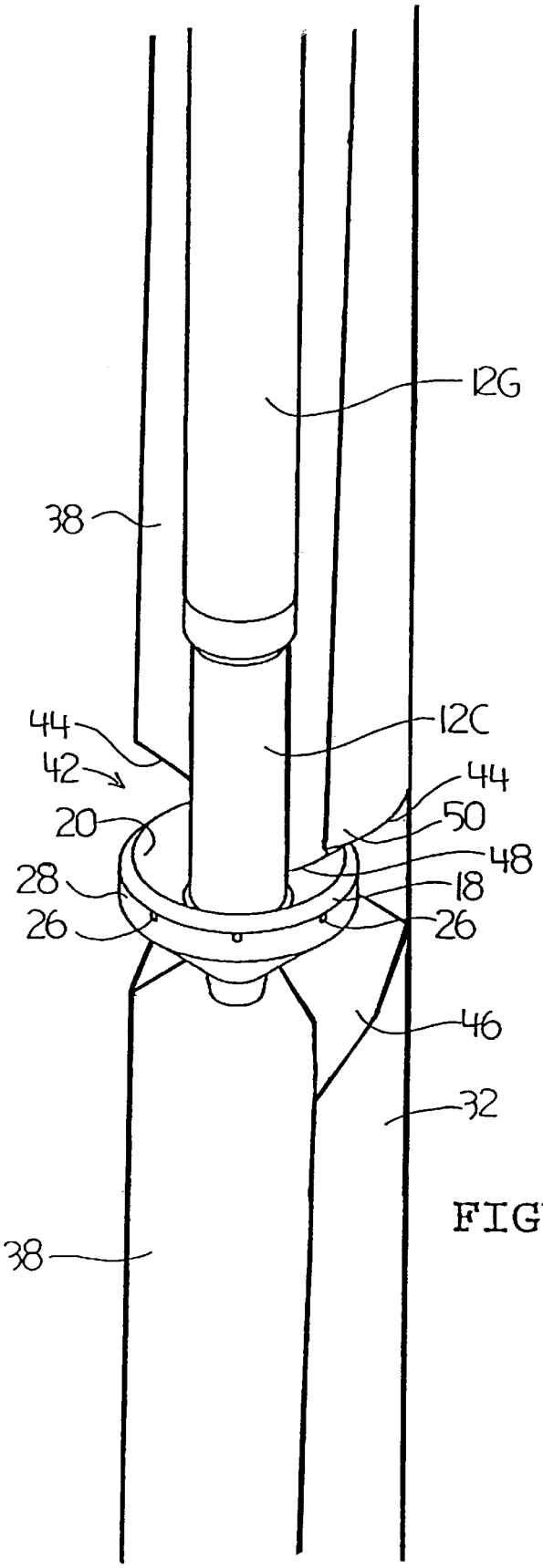
FIG. 2 is a perspective view of a retrieving tool engaged with a retrievable whipstock according to the invention.

Referring to the figures, and in particular FIG. 1, a downhole retrieving tool 10 is formed of a tubular member 12 with one end 14, referred to as a tubing string connector end, adapted for connection, as for example by conventional threading 13, to a conventional tubing string (not shown). The tubular member 12 includes, preferably at the other end 16 of the tubular member 12 and spaced from the end 14, a retrieving dish 18 that extends circumferentially around the tubular member 12. The retrieving dish 18 extends radially away from the tubular member 12 in a direction that is inclined towards the end 14, thus forming a dish with an inner concave surface 20 that opens towards the end 14. In a preferred embodiment of the invention, the inner concave surface 20 is conical. The retrieving dish 18 may have an outer convex surface 22 parallel to the inner concave surface 20, although it is preferred that the retrieving dish 18 thin slightly in the radially outward direction such that the surfaces 20 and 22 are slightly off parallel.

The tubular member 12 has a bore 24 that communicates with fluid passageways 26 spaced circumferentially around the retrieving dish 18 and which terminate at the perimeter 28 of the retrieving dish 18. The fluid passageways 26 collectively preferably have a smaller total cross-sectional area than the cross-section of the bore 24, so that fluid injected into the bore 24 has a greater pressure in the fluid passageway 26, thus resulting in more effective jets.

Stabilizers 29 are preferably spaced around the tubular member 12 at the end 14. A second set of stabilizers (not shown) may be spaced around the tubular member at the end 14 and axially spaced from the stabilizers 29.

Figure 3A:
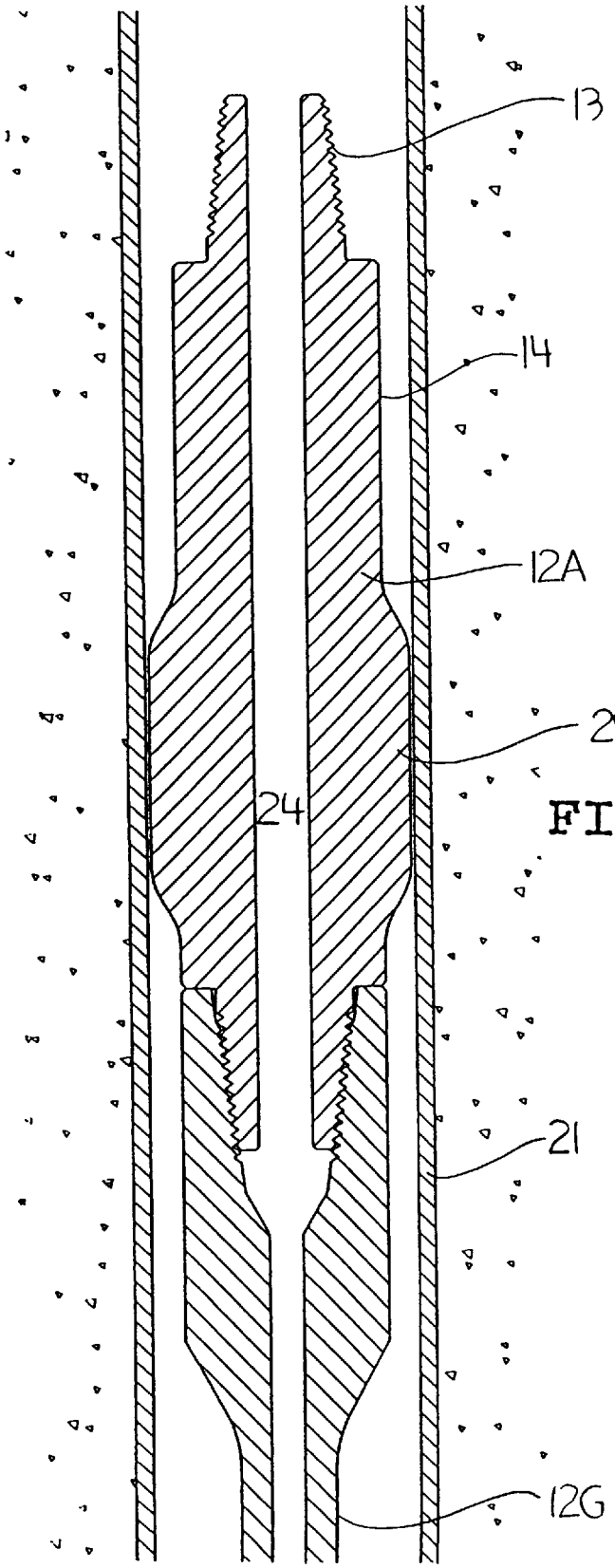
FIGS. 3A–3D together form a section through a retrieving tool in position in a well to retrieve a retrievable whipstock from a well.
Figure 3B:
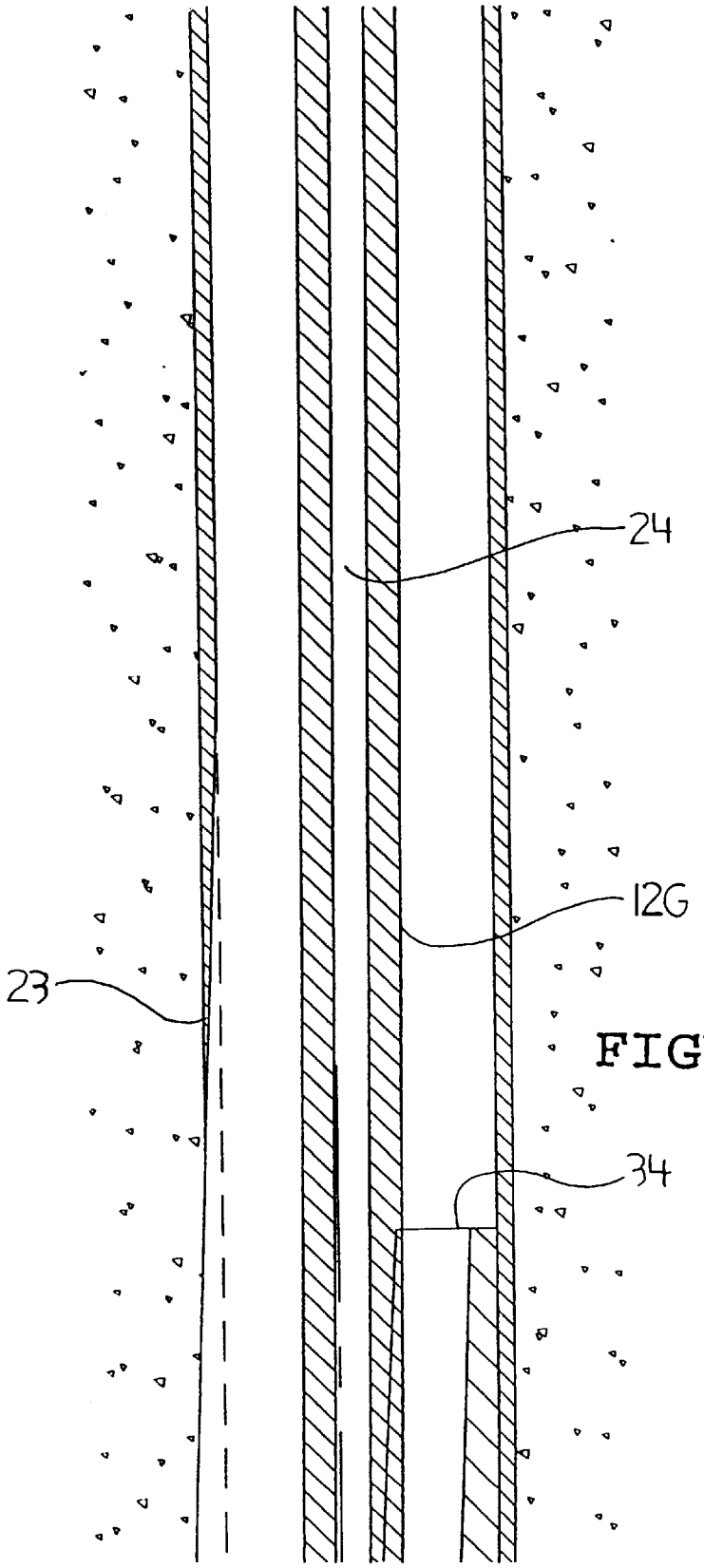
Figure 3C:
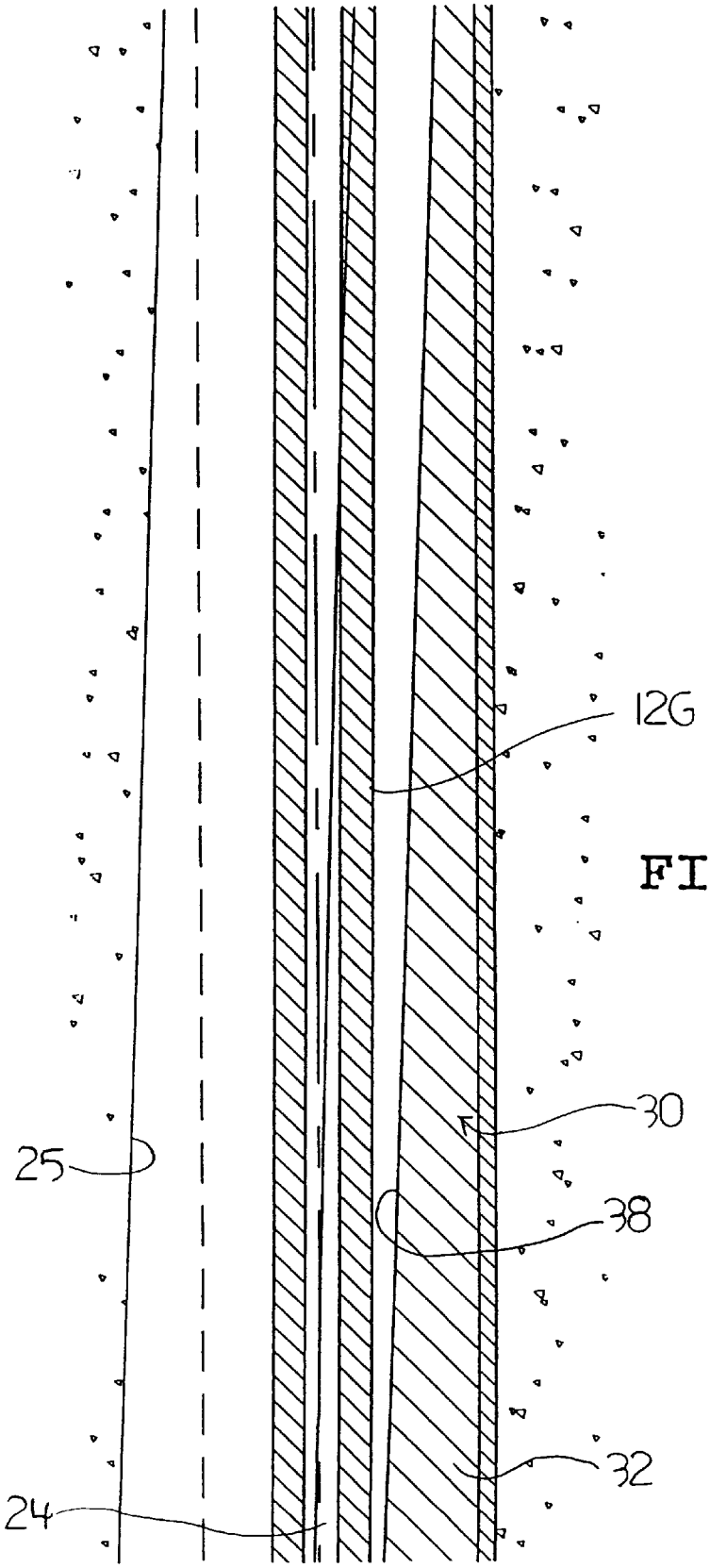
Figure 3D:
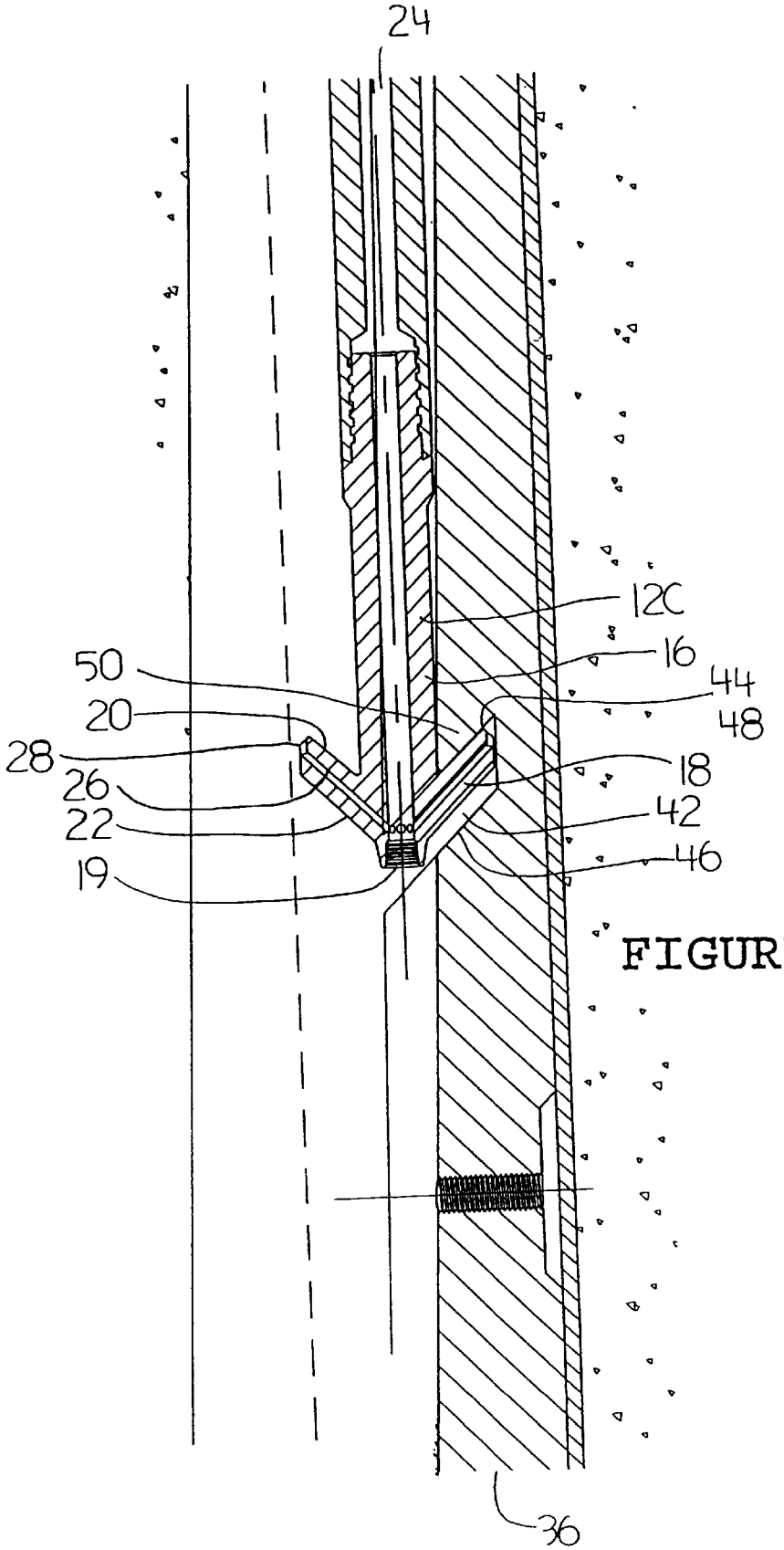

Referring to FIGS. 3A–3D, the retrieving tool 10 may be formed of a first tubular portion 12*a* forming the end 14, which is threaded onto an intermediate tubular portion 12*b*, and which is in turn threaded onto a lower tubular portion 12*c* at the end 16. A plug 19 may be used to plug the end of the bore 24. FIG. 3A shows the well bore with conventional casing 21. FIG. 3B shows the casing partly cut away as shown at 23 for example after a milling operation. The well bore at 25 in FIG. 3C is shown slanting away from the whipstock 30 with the same slant angle as the concave face 38.

Referring in particular to FIGS. 3A–3D, a retrievable whipstock 30 is formed of an elongated body 32 having a narrow (upper) end 34 and a wide (lower) end 36. On one side of the retrievable whipstock 30 is a slanted concave face 38 extending along the elongated body 32 between the ends 34 and 36. Whipstocks with slanted concave faces are conventional in themselves and need not be discussed further. According to the invention, a recess 42 is formed in the elongated body 32 and defined by an upper side wall 44 and lower side wall 46. The recess 42 is designed to be received by and caught on the retrieving dish 18. For this purpose, the upper side wall 44 is convex, to mimic the inner concave surface 20 of the retrieving dish, and slants down towards the wide end 36 of the elongated body 32. The upper side wall 44 intersects the slanted concave face 38 along an edge 48, which forms a catch point that may be hooked by the retrieving dish 18. Preferably, the upper side wall 44 forms a conical surface matching the inner concave surface 20 of the retrieving dish 18. The lower side wall 46 is flat for ease of machining. It is preferred that the angle of inner concave surface 20 of the retrieving dish 18 to the axis of the retrieving tool 10 is slightly greater than the angle of the upper side wall 44 to the axis of the retrieving tool 10 when it is in position with the retrieving dish 18 in the recess 42. This helps ensure that contact between the retrieving dish 18 and the upper side wall 44 is greatest nearer to the tubular member 12, thus reducing the moment on the retrieving dish 18. Any of various machining techniques may be used to create the recess 42.

The upper side wall 44 defines an anchor 50 for the retrieving dish 18, and the anchor is preferably formed integrally with the elongated body 32. Provision of a recess 42 defined by upper and lower side walls 44, 46 that match the shape of the retrieving dish 18 maximizes the surface area on the slanted concave face 38 where mills slide during milling operations. Since the recess is slanted downward during operation, the design frees the anchor 50 from milling cuttings. Further, if the slanted face 38 wears during milling operations, the edge 48 migrates inward but the anchor 50 retains its overall shape and function.

With matching surfaces 20, 44 and 22, 46, maximum contact may be obtained between the retrieving dish 18 and anchor 50. In a preferred embodiment, since the retrieving dish 18 extends around the tubular member 12, the whipstock 30 can be in any rotational position within a well, yet still retain the same contact area between the dish 18 and anchor 50.

In operation, a whipstock 30 or other downhole tool having a recess and anchor for receiving a retrieving dish is assumed to be located in a well. The retrieving tool 10 is first lowered into the well. Once the retrieving dish 18 comes into contact with the concave of the whipstock 30, it slides along the slanted concave surface 38. As the retrieving tool 10 slides along the slanted concave surface 38, the retrieving dish 18 is moved away from the center of the wellbore as the stabilizers 29 tend to keep the tubular member 12 centered in the wellbore. The tubular member 12 flexes as the retrieving dish 18 moves away from the center of the well bore and places pressure on the retrieving dish 18 that tends to force the retrieving dish 18 laterally into the recess 42. Once the retrieving dish 18 has been lowered past the anchor 50, it is then pulled upwards. A jet of fluid through the passageways 26 may be used to remove filings or other unwanted material from the recess 42 while the retrieving dish 18 is being inserted into the recess 42. The retrieving dish 18 enters the recess 42 under pressure from the flexing of the tubular member 12 and engages the anchor 50. The tubing string, including retrieving tool 10 and whipstock 30 is then removed from the well.

The retrieving dish also has utility if it extends around only a portion of the circumference of the tubular member. In this instance, the inner surface of the dish remains concave, but the dish forms a hook with a concave inner surface facing the tubular member. When the inner concave surface of the hook engages an anchor with a matching engaging surface, increased contact area is obtained. In general, the more the hook extends around the tubular member, the better the performance of the hook, the best performance being obtained when the hook extends 360° around the tubular member to form a dish, such that orientation of the hook within the wellbore is not of concern. However, in some cases there may not be enough room for the entire dish to fit past the top of the whipstock and therefore a smaller dish, for example one extending around 180° of the tubular member would be preferable. The retrieving dish 18 need not be conical but may for example be other shapes, such as spherical.

The retrieving tool must clearly have sufficient tensile strength to remove a whipstock from a well, and any joints should of course be constructed according to known principles in the construction of oil well equipment. All of the usual safety precautions should be taken in the fishing and retrieving of downhole tools.

A person skilled in the art could make immaterial modifications to the invention described in this patent document without departing from the essence of the invention that is intended to be covered by the scope of the claims that follow.

The embodiments of the invention in which an exclusive property or privilege is claimed are defined as follows:

1. A downhole retrieving tool, comprising:

a tubular member having a tubing string connector end;

a retrieving dish on the tubular member spaced from and opening towards the tubing string connector end, the retrieving dish having greater diameter than the tubular member and extending circumferentially around the tubular member, thereby forming multiple hooking positions.

2. The downhole retrieving tool of claim 1 in which the retrieving dish is defined by inner and outer conical surfaces.

3. The downhole retrieving tool of claim 2 in which the tubular member has a bore, and the retrieving dish has a perimeter, and further including plural fluid passageways in fluid communication with the bore and extending through the retrieving dish to the perimeter of the retrieving dish at spaced circumferential positions.

4. The downhole retrieving tool of claim 3 in which the tubular member comprises stabilizers spaced around the tubular member at the tubing string connector end.

5. The downhole retrieving tool of claim 1 in which the tubular member comprises stabilizers spaced around the tubular member at the tubing string connector end.

6. A tool for retrieving objects from wells, the tool comprising:

a tubular member having first and second ends, the first end being adapted for connection to a tubing string;

a hook extending radially away from the tubular member at the second end and inclined towards the first end of the tubular member; and the hook having an inner concave surface facing the tubular member, and the hook extending radially outward further than the tubular member.

7. The tool of claim 6 in which the hook extends circumferentially around the tubular member to form a dish.

8. The tool of claim 7 in which the inner concave surface of the hook forms a first conical surface.

9. The tool of claim 8 in which the hook has an outer convex surface.

10. The tool of claim 9 in which the outer convex surface forms a second conical surface.

11. The tool of claim 7 in which the tubular member has a bore, and the hook has a perimeter, and further including plural fluid passageways in fluid communication with the bore and extending through the hook to the perimeter of the hook at spaced circumferential positions.

12. The tool of claim 7 in which the tubular member comprises stabilizers spaced around the tubular member at the first end.

13. A retrievable whipstock, comprising:

an elongated body having a narrow end and a wide end and a slanted concave face on a first side of the elongated body, the slanted concave face extending along the elongated body between the narrow and wide ends;

a recess formed in the elongated body between upper and lower side walls, the upper side wall being closer to the narrow end of the elongated body than the lower side wall; and the upper side wall being convex and slanting down towards the wide end of the elongated body to intersect the slanted concave face and form a catch point for a concave hook.

14. The retrievable whipstock of claim 13 in which the upper side wall forms a portion of a conical surface.

15. The retrievable whipstock of claim 14 in which the lower side wall is concave.

16. The retrievable whipstock of claim 15 in which the lower side wall forms a portion of a conical surface.

17. A method of retrieving a downhole tool in a well, wherein the downhole tool has a recess and anchor for receiving a retrieving dish, the method comprising the steps of:

lowering into the well a retrieving tool formed of a tubular member and a retrieving dish extending circumferentially around the retrieving tool to form multiple hooking positions;

inserting the retrieving dish into the recess and engaging the anchor; and pulling on the retrieving tool to remove the downhole tool from the well.

18. The method of claim 17 in which the retrieving tool has a bore, and the retrieving dish includes circumferentially spaced fluid passageways communicating with the bore, and the method further comprising, before inserting the retrieving dish into the recess, injecting fluid down the bore, through the fluid passageways and into the recess to remove unwanted material from the recess.

19. The method of claim 17 in which the downhole tool is a retrievable whipstock having a slanted concave face, and the retrieving tool is provided with stabilizers uphole of the retrieving dish such that, upon the retrieving dish contacting the slanted concave face, the retrieving tool flexes and urges the retrieving dish towards the recess.

20. The method of claim 17 in which the recess has an upper side wall, the retrieving dish has an inner concave surface and the tubular member has an axis, and the inner concave surface has a greater angle to the axis than the upper side wall when the retrieving dish is in the recess.

* * * * *